United States Patent [19]

Matasa

[11] 3,971,478

[45] July 27, 1976

[54] OVERHEAD CRANE WITH LIFTING BEAM PROVIDED WITH C-SHAPED CLAWS

[75] Inventor: Vasile Matasa, Bucharest, Romania

[73] Assignee: Institutul de Proiectare Tehnologica Pentru Laminoare —IPROLAM—, Bucharest, Romania

[22] Filed: Oct. 10, 1974

[21] Appl. No.: 513,491

[52] U.S. Cl. ..... 212/11; 294/67 A

[51] Int. Cl.[2] ..... B66C 17/06; B66C 19/00

[58] Field of Search ..... 212/11, 14, 15, 16, 212/18, 20, 21, 22, 26, 27; 294/67 AA, 67 AB, 73, 67 A

[56] References Cited

UNITED STATES PATENTS

| | | | |
|---|---|---|---|
| 912,406 | 2/1909 | Patterson | 212/22 |
| 982,883 | 1/1911 | Schnabel | 212/22 |
| 1,296,756 | 3/1919 | Buckley | 212/10 |
| 3,436,113 | 4/1969 | Zweifel | 212/14 |
| 3,598,440 | 8/1971 | Ramsden | 212/125 |
| 3,647,255 | 3/1972 | Hale | 212/127 |
| 3,743,107 | 7/1973 | Verschoof | 212/125 |
| 3,746,182 | 7/1973 | Tak et al. | 212/14 |
| 3,825,128 | 7/1974 | Cooper | 212/11 |
| 3,842,986 | 10/1974 | Hupkes | 212/125 |

FOREIGN PATENTS OR APPLICATIONS

| | | | |
|---|---|---|---|
| 211,082 | 6/1909 | Germany | 212/11 |

*Primary Examiner*—M. H. Wood, Jr.
*Assistant Examiner*—David M. Mitchell

[57] ABSTRACT

Overhead crane particularly useful in the iron and steel industry for handling rolled material. The crane is provided with a load crab equipped with a circular rail on which there rotates another crab provided with mechanisms which by means of wire ropes operate the means for lifting/lowering, orienting and tilting the load beam which is provided with C-shaped shaped claws. All these wire ropes are inclined thereby providing a positive means for preventing the oscillation of the load. A special arrangement of the runs of the wire ropes and of the rope drums and pulleys ensure that the operations of load lifting and lowering, loading and unloading, and orienting operations are under accurate control.

5 Claims, 10 Drawing Figures

FIG. 1
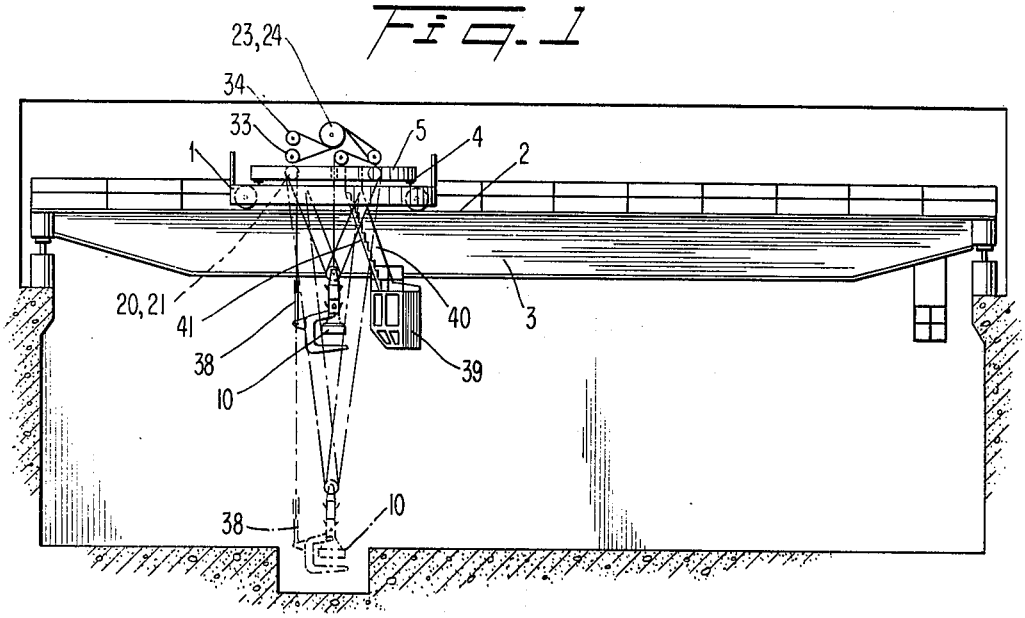
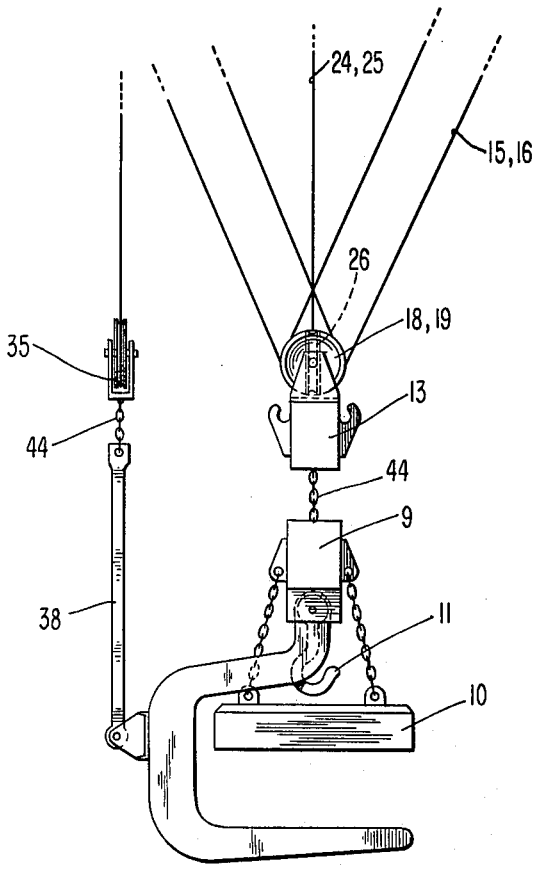
FIG. 10
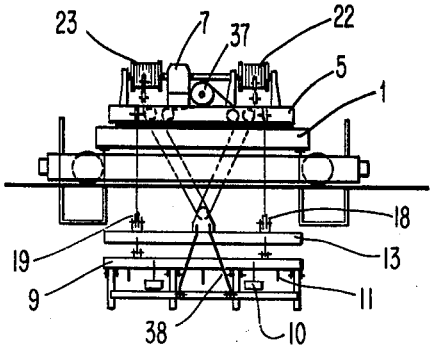
FIG. 2

OVERHEAD CRANE WITH LIFTING BEAM PROVIDES WITH C-SHAPED CLAWS

The present invention relates to an overhead crane having a lifting beam provided with "C"-shaped claws and magnets, such crane being characterized by its reduced construction weight; the crane may be used to transfer rolled products throughout the process flow of steel mill areas, and may also be used within mill storage areas as well as to carry rolled stock to and from the transportation means.

For the above mentioned application, a number of overhead designs have heretofore been used with some degree of success, like the overhead crane types having beams provided with claws and magnets consisting of a steel bridge structure provided with one or two drive trains. On top of the steel bridge there is a transversely movable trolley provided with traversing gear and one circular track secured on the top of the trolley thereby allowing rotary movement about a vertical axis of a rotatable crab which is provided with two mechanisms, i.e. the hoist that lifts and lowers the load, and the gear for the rotation of the rotatable crab. The crab is provided at its bottom with a sturdy turret of either lattice or box structure type design which is provided with appropriate catwalks on which the device for the tilting of the load carrying beam is installed; the control cab of the crane is disposed beside this turret in a cantilevered arrangement.

The turret guides a vertical sliding mast or masts which are provided at its or their lower section with a specially designed load beam, from which there is hinged a lifting beam fitted with C-shaped claws. For auxiliary lifting, the load carrying beam is equipped with one to three lifting magnets and two to six hooks installed at the bottom of the load beam, whereas on the said beam there are installed pulleys; the full assembly, including the guiding mast or masts, load beam, and the beam fitted with C-shaped claws, is selectively lifted and lowered and driven by hoist mechanisms installed on the load-carrying rotatable crab.

The horizontal forces generated by the swinging of the C-shaped claws and the lifting beam during loading and unloading of the products absorbed by this stiff system, which absorbs the forces generated by the starting and braking of the overhead crane and the load trolley, relieves swinging of the load, and allows high speed operation during both overhead crane and trolley travel as well as making possible a quick positioning of the load beam.

With this stiff type of overhead crane load support, the horizontal forces created during operation at the lower level of the load carrier require the taking into consideration of strength calculations of the masts, the turret, frame, crab, as well as the bridge and the values of horizontal forces applies to the C-shaped claw carrier. Such forces are capable of initiating the tilting of the load crab on two of its wheels and/or the slippage of the crane wheels and those of the load crab.

All these requirements lead to a very heavy weight crane design and high manufacturing costs which are serious drawbacks.

Another disadvantage of such a crane system is its sophisticated design due to the stiffness requirements imposed by the mast type turret that requires rather high buildings and strong runways to resist the large forces generated by the overhead crane wheels. It is a principal object of the present invention to provide an overhead crane in which the above mentioned disadvantages are eliminated or at last substantially reduced.

The overhead crane in accordance with this invention has a lifting beam with C-shaped claws and avoids the said disadvantages through lowering or lifting, by means of pairs of ropes; the lifting beam is provided with C-shaped claws, in order to minimize weight, to simplify the design, and to improve the building and storage efficiency of the crane; on the other hand, in order to suppress the swinging of the load, the ropes are inclined with the starting end of each rope secured to the rotatable crab and the opposite end, after being entrained over balance pulleys, is installed on the lifting beam fitted with C-shaped claws and is guided by means of guiding pulleys, and is finally wound in a suitable manner around driven drums installed on the rotatable crab. The arrangements of these rope drums are either symmetrical or asymmetrical with respect to the center figure-line of the crab; to achieve either the tilting or the turning of the tilting and lifting movements of the lifting beam provided with C-shaped claws, the rotatable crab is provided with an appropriate tilting mechanism which also has an inclined arrangement of ropes, the starting ends of these ropes are wound around the same rope drum that lifts the lifting beam which is provided with C-shaped claws, and the opposite wire rope end, after being entrained over an assembly of balance pulleys, whose center of rotation is located sidewise at a distance from the longitudinal center-line of the horizontal beam. The balance pulleys are located as closely as possible to the horizontal plane passing through the centers of rotation of the balance pulleys, which are fitted on the lifting beam. The wire rope is afterwards lead by other guide pulleys and finally wound around on the drum of the tilting device drum which is also installed on the rotatable crab. The assembly of balance pulleys which is common to both mechanisms support the lifting beam provided with C-shaped claws by means of a hinged attachment device by linking it outside its longitudinal center-line; in order to enhance the versatility of the overhead crane, this lifting beam may also be supported on the lifting wire ropes by means of an auxiliary load beam; in the case when, during loading and unloading operations, horizontal forces are generated which could throw out of balance the system designed to suppress the swinging of the load, the said lifting beam provided with C-shaped claws is hung from an auxiliary beam and the pulley assembly of the tilting mechanism by means of chain members of equal length.

These and other objects and advantages of the present invention will appear later as this disclosure progresses, reference being made to the accompanying drawings which illustrate four embodiments in accordance with the invention.

In the drawings:

FIG. 1 is a front elevational view of the overhead crane;

FIG. 2 is a side elevational view of the overhead crane of FIG. 1;

FIG. 10 is a simplified front elevational view of the fourth embodiment of the lifting beam fitted with C-shaped claws, the lifting beam being attached to the auxiliary beam through chain members.

Figure 3:
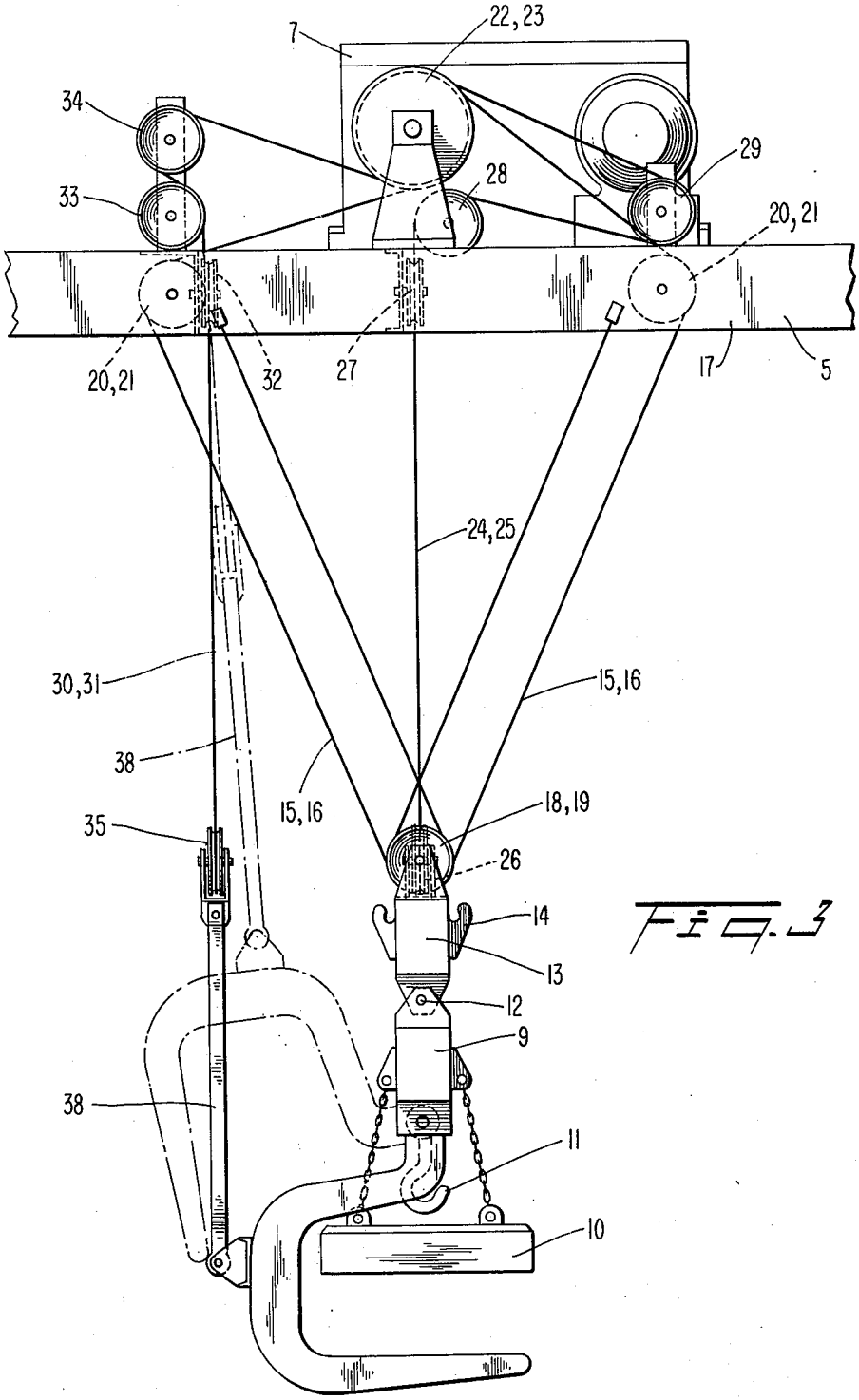
FIG. 3 is a simplified front elevational view of the first embodiment of a load carrier system with an auxiliary beam and central arrangement of rope drums.
Figure 4:
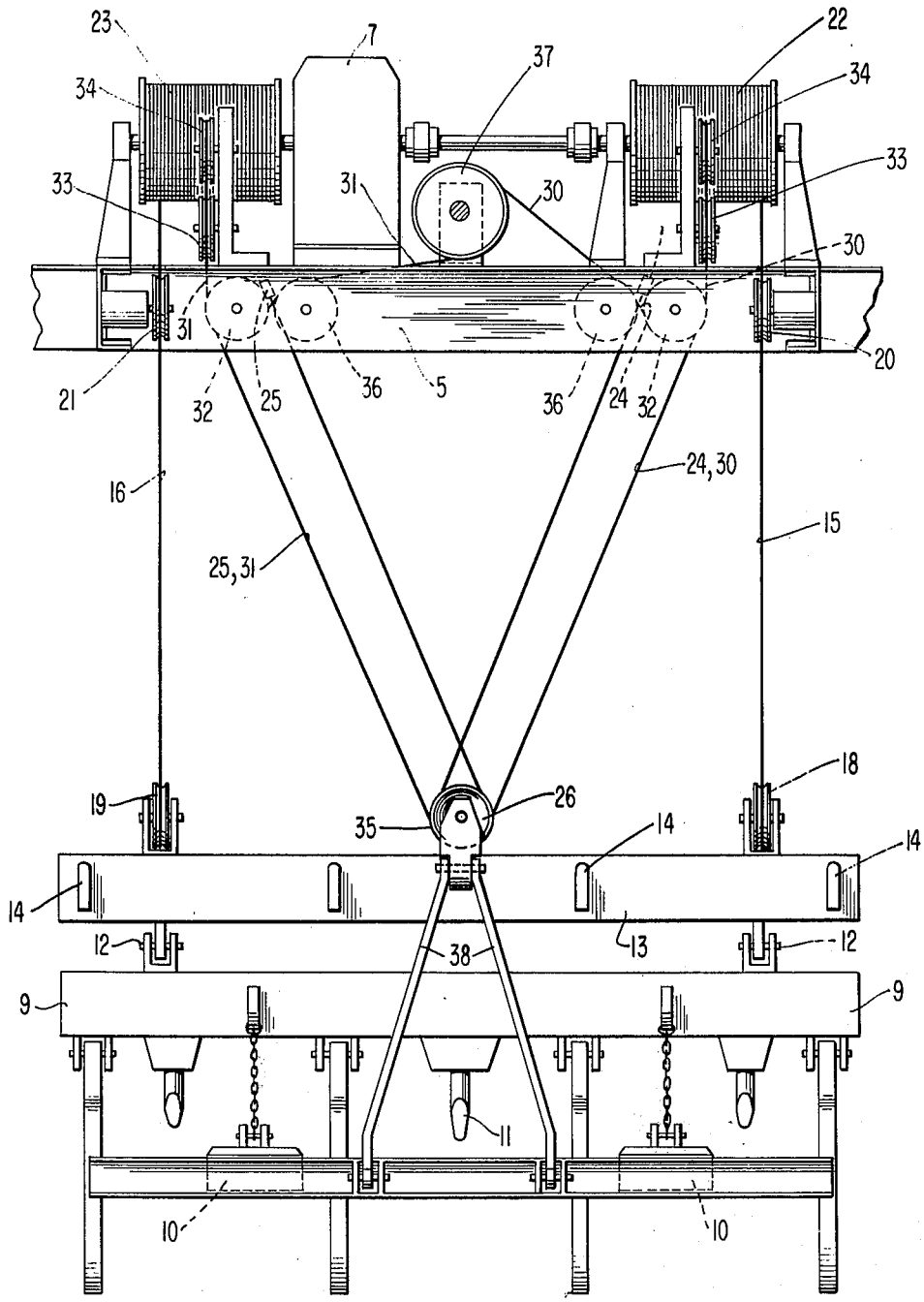
FIG. 4 is a simplified side elevational view of the load carrier system of FIG. 3.
Figure 5:
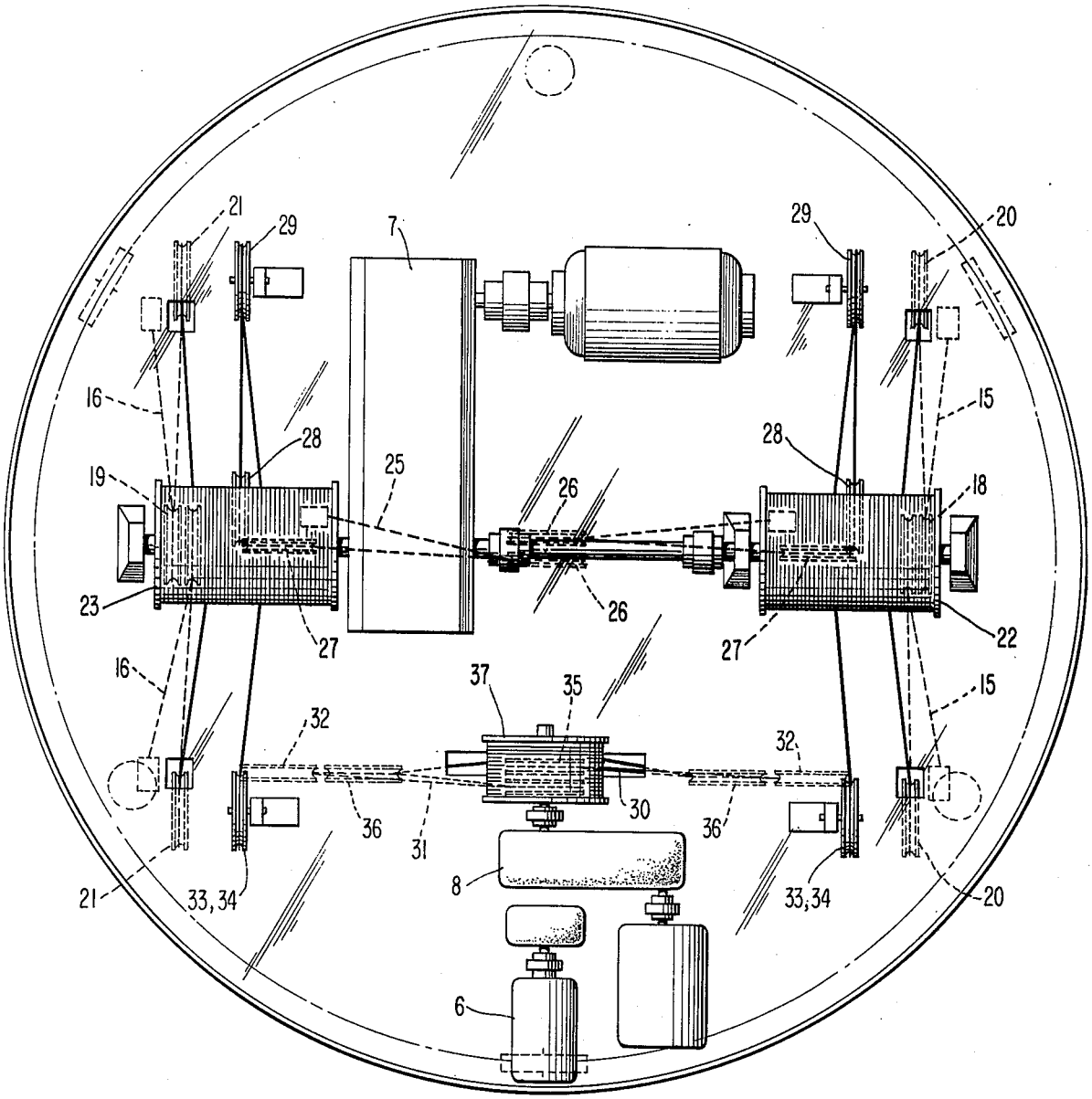
FIG. 5 is a plan view of the rotatable crab in the embodiment of FIG. 3 illustrating the arrangement of driving mechanisms, of load ropes, guiding pulleys as well as the central and in-line arrangement of the load rope winding drums.

Turning first to the embodiment of FIGS. 1–5 inclusive, the overhead crane in accordance with the invention, includes a load trolley moving on tracks 2 fitted to the steel bridge 3 of the overhead crane.

On top of the load trolley 1 there is a circular track 4 on which there is a rotatable crab 5 provided with a swivelling mechanism 6, hoist mechanism 7, a lifting beam 9 provided with C-shaped claws, and a tilting mechanism 8 for the beam and claws. The load carrier system includes the lifting beam 9 provided with C-shaped claws featuring the tilting movement, and is equipped with from one to four lifting magnets 10 and lifting hooks 11, the lifting beam assembly being suspended on the auxiliary beam 13 by means of linking pin members 12. These pin members 12 allow the dismantling of the lifting beam 9 provided with C-shaped claws, thus allowing the overhead crane 3 also to fulfill other handling operations, e.g. the handling of rolled products stored on racks: in this case the load is taken by means of hooks 14 located on the auxiliary beam 13.

The pairs of ropes 15, 16 as well as two other ropes 24 and 25 are provided for lifting and lowering the auxiliary load beam 13, and also to suppress load swinging, the ropes being inclined in two vertical planes.

The ropes 15 and 16 have their starting ends secured to the frame of the rotatable crab 5 and their opposite ends, after being entrained over balance pulleys 18, 19, which are located with their axis of rotation passing through the longitudinal center-line of the auxiliary beam 13, are directly entrained over guide pulleys 20, 21 and finally are wound round the section threaded with double thread of the drums 22 and 23 which are mounted centrally on the rotatable crab 5. Each of the balance pulleys 18, 19 include multiple sheaves to receive the respective pair of ropes. However, for simplicity in FIG. 4 only one sheave and rope has been shown for each pulley. A similar simplification is used for the pulley 35 in FIGS. 3 and 10, 35″ in FIG. 7, and 18″ and 19″ in FIG. 8.

The starting ends of the cables 24 and 25 are secured on the frame 17 of the rotatable crab and their opposite ends after being entrained on balance pulleys 26 installed on the auxiliary beam 13 with their axis of rotation normal to the longitudinal center-line of the auxiliary beam 13, and then are quided by three pairs of guiding pulleys 27, 28, 29, being then normally brought to the same drums 22 and 23 provided with double thread sections where the ropes are finally wound.

To obtain either the tilting or the turning of the tilting and lifting movements of the lifting beam 9 provided with C-shaped claws, the latter is attached by the wire ropes 30 and 31 arranged at an inclined pattern. The starting ends of the wire ropes 30 and 31 are normally brought to the same drums 22 and 23 after being entrained on three pairs of guide pulleys. The final ends of the ropes 30 and 31 are entrained on an assembly 35 of balance pulleys, whose center of rotation is located sidewise at a distance from the longitudinal center-line of the lifting beam; however, assembly 35 is situated in height as nearly as possible to the horizontal plane passing through the centers of rotation of the balance pulleys 18, 19 and 26 secured to the auxiliary beam 13; the ropes 30, 31 are afterwards entrained over the other guide pulleys 36 and are finally wound around the section of the drum 37 provided with double threading of the tilting mechanism 8 located on the rotatable crab. The assembly of balance pulleys 35, common to mechanisms 7 and 8, is attached by means of hinged attaching members 38 sidewise at a distance from the longitudinal center-line of the lifting beam. The electric control cab 39 of the overhead crane 3 is arranged at one side of the center-line of the rotatable crab 5 to allow the operator a good visibility over the load area.

The control cab 39 is suspended on the rotatable crab 5 by means of a steel structure 40 which is provided inside with stairs 41 for the direct access thereto of crane operators from the control cab 39 to the rotatable crab 5.

Figure 6:
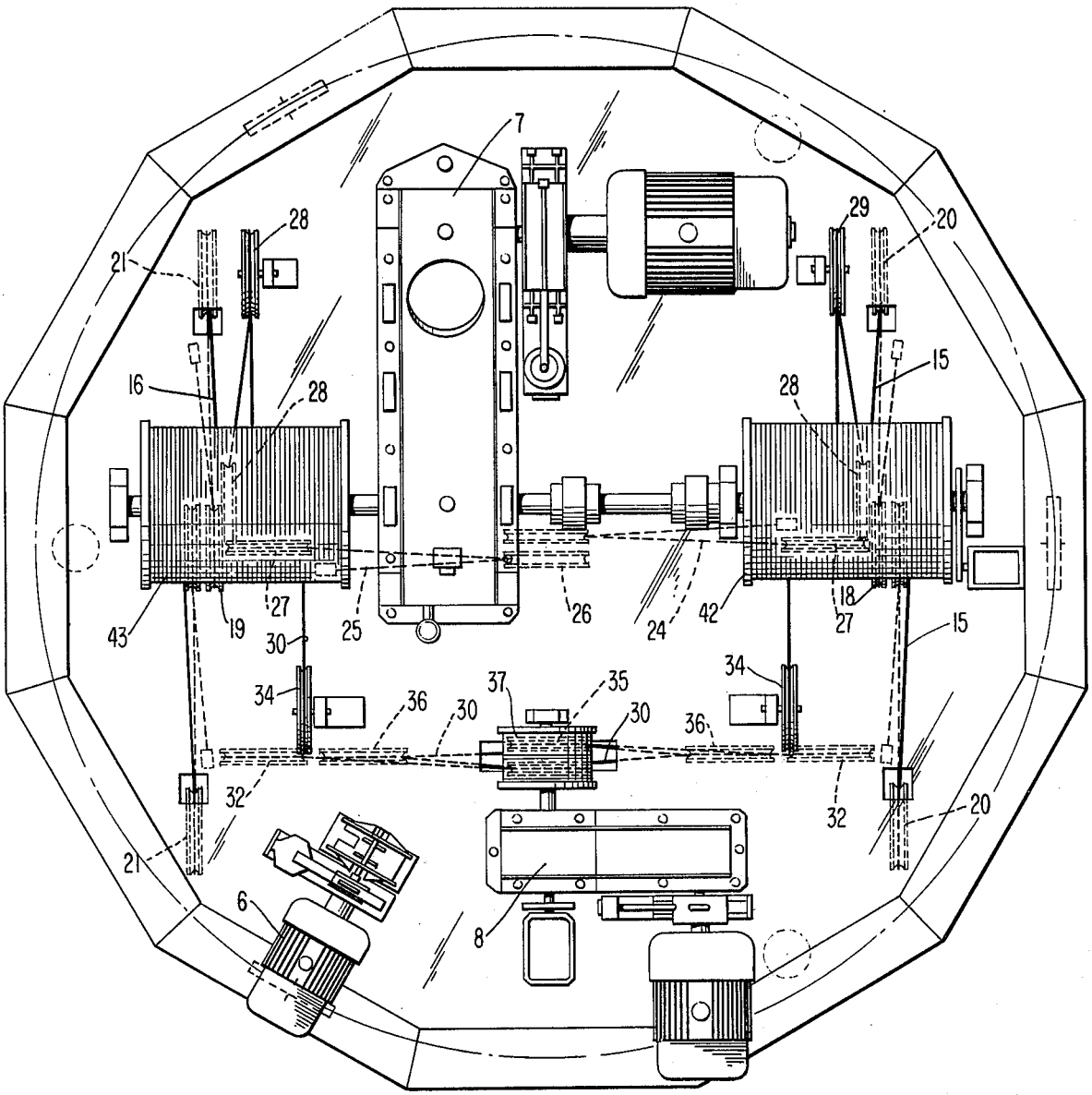
FIG. 6 is a plan view of a second embodiment of the rotatable crab illustrating the asymmetrical and in-line arrangement of the load rope winding drums.

In the second embodiment in accordance with FIG. 6, drum 42′ and 43′ are asymmetrically located in respect of the center-line of the rotatable crab 5, each of these drums being provided with four rope winding sections. This embodiment is not provided with pulleys corresponding to pair of pulleys 33 of the first embodiment, the pair of pulleys 34 is relocated as shown at 34′ and the drum 37′ is provided with two winding sections independently for each rope. Parts in FIG. 6 which are similar to those in FIGS. 1–5 inclusive, are designated by the same reference characters with an added prime.

Figure 7:
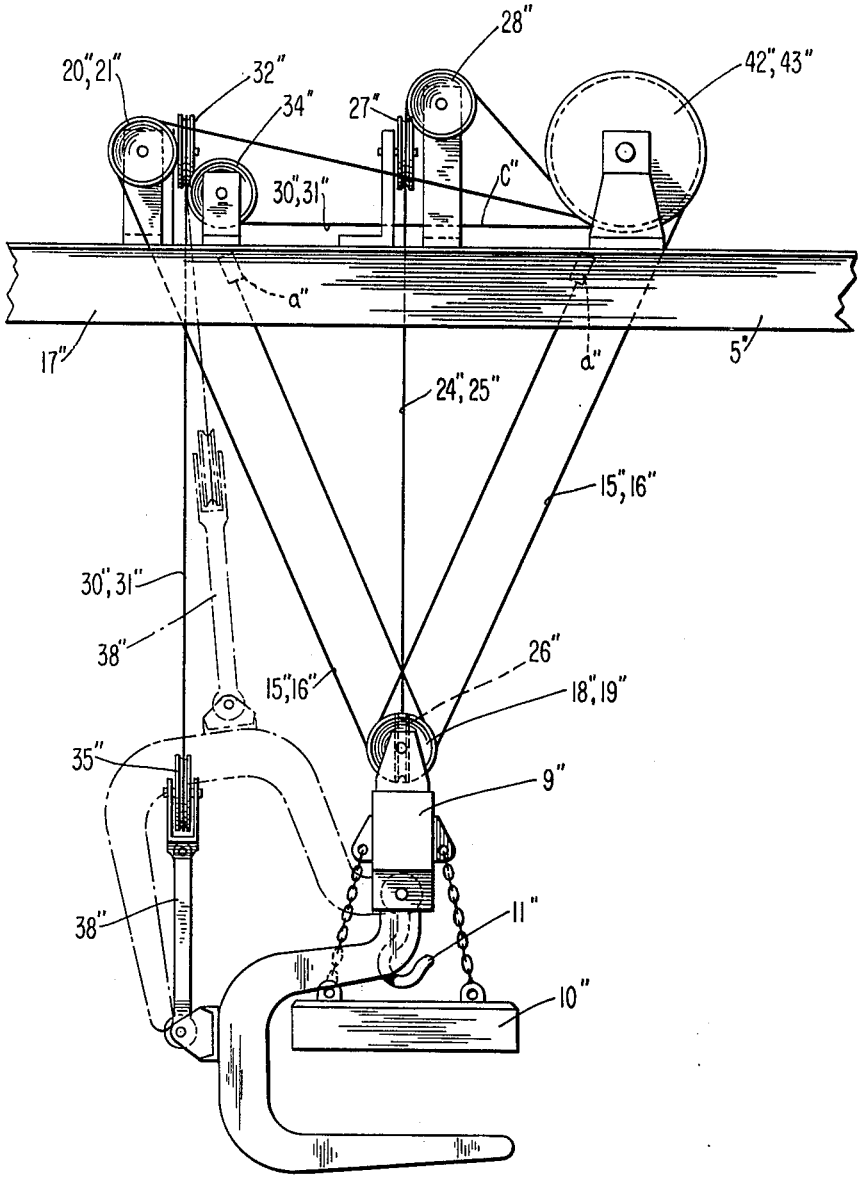
FIG. 7 is a simplified front elevational view of a third embodiment of the load carrier system without auxiliary beam and sidewise arrangement of the load ropes winding drums.
Figure 8:
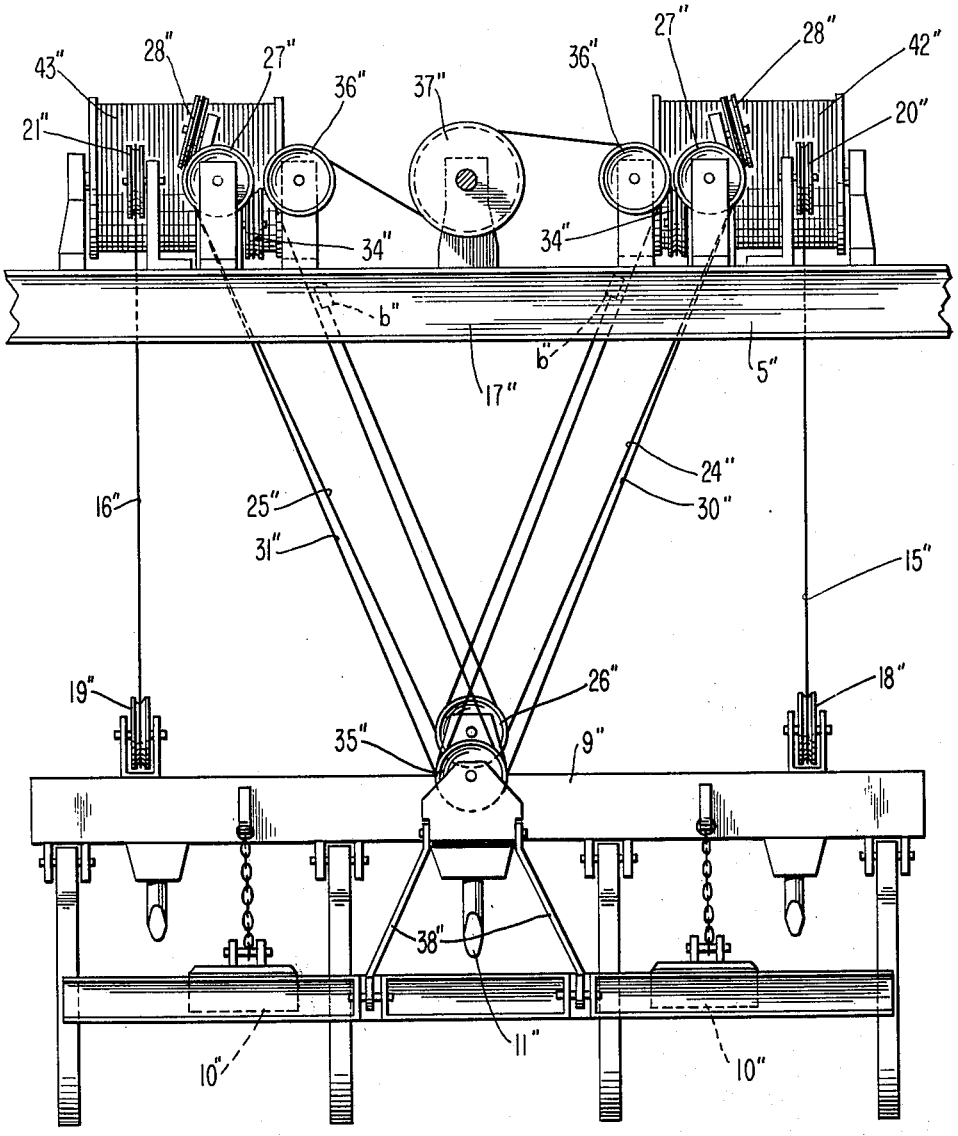
FIG. 8 is a simplified side elevational view of the load carrier system of FIG. 7 without auxiliary beam and sidewise arrangement of load ropes drums.
Figure 9:
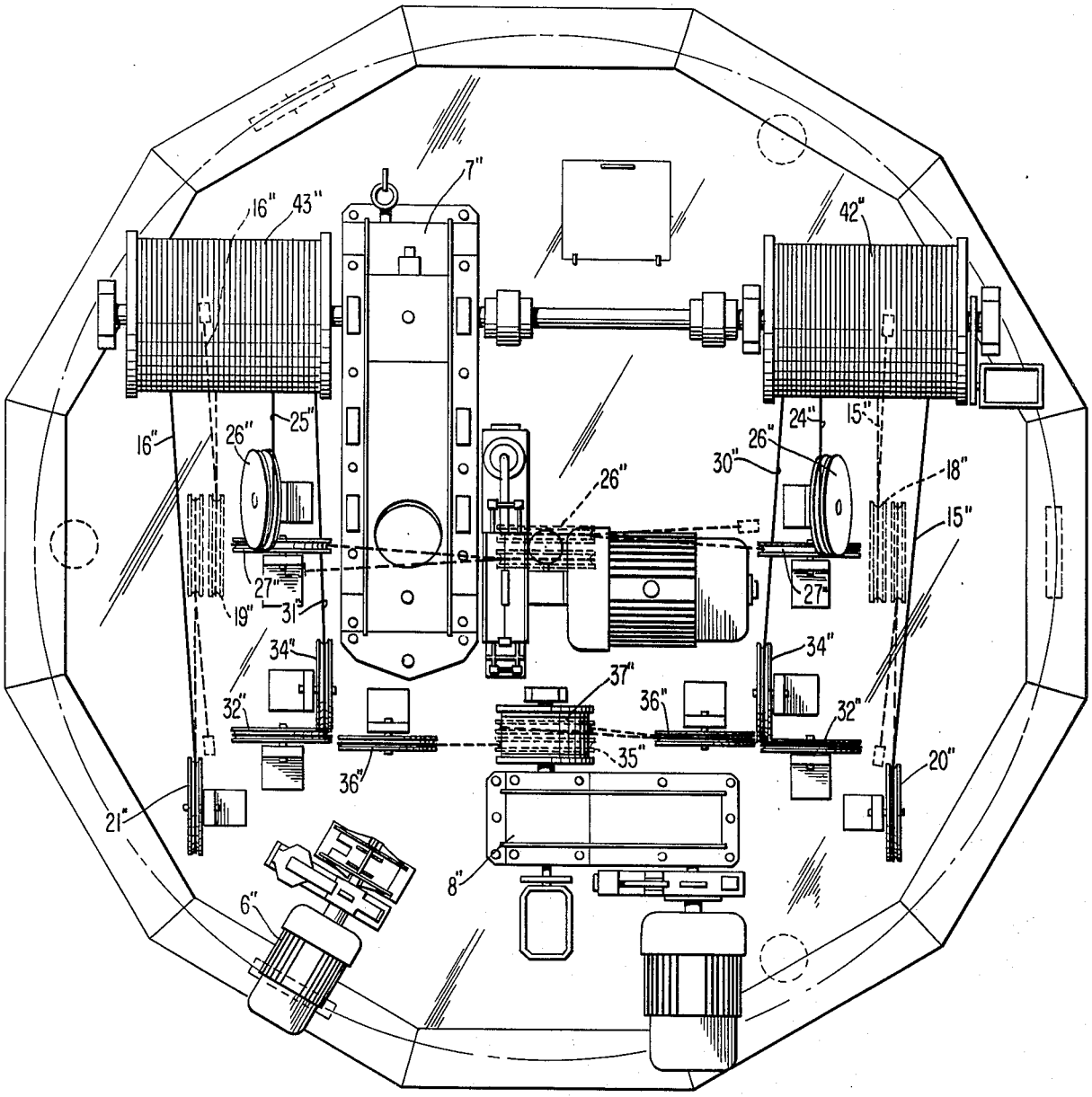
FIG. 9 is a plan view of the rotatable crab of FIG. 7 showing the sidewise and in-line arrangement of the load ropes winding drums.

In a third embodiment, shown in FIGS. 7, 8 and 9, two drums 42″ and 43″ featuring simple threads are located sidewise for lifting and lowering beam 9″ provided with C-shaped claws. Also, in order to suppress the swinging of the load, two pairs of ropes 15″ and 16″ and another two ropes 24″ and 25″ are provided, such ropes lying in inclined arrangement in two vertical planes.

The pair of ropes 15″, 16″ has the starting ends *a″* secured to the frame 17″ of the rotatable crab 5″ and the opposite ends, after being entrained on the balance pulleys 18″, 19″ installed with their plane normal to their rotation axis passing through the longitudinal center-line of the beam 9″ half of the number of ropes is directly wound around the corresponding sections of drums 42″ and 43″, the other half of the ropes being led by means of pulleys 20″ and 21″ to be wound round the same drums 42″ and 43″.

In order to guide the ropes 24″ and 25″, the starting ends *b″* of the ropes are secured to the frame 17″ of the rotatable crab 5″ and their opposite ends, after being entrained through the balance pulleys 26″, located with their symmetry plane normal to their axis of rotation passing through the longitudinal center-line of the beam 9″, are afterwards normally brought to the same winding drums 42″ and 43″, the guiding of the ropes 24'' and 25'' being accomplished by the guide pulleys 27'' and 28''.

To accomplish either the tilting or the turning of the tilting and lifting movements of the lifting beam 9'' provided with C-shaped claws, this beam is attached by means of load ropes 30'' and 31'' featuring an inclined pattern arrangement. The starting ends *c''* of ropes and 30'' and 31'' are normally brought up to the drums 42'' and 43'' after being guided by the pair of guiding pulleys 32'' and 34''. The final ends of the ropes 30'' and 31'', after being entrained over the assembly of balance pulleys 35'' whose center of rotation is located sidewise at a distance from the lifting beam longitudinal centerline, in height being however located the most nearly possible to the horizontal plane passing through the rotation center of the balance pulleys 18'', 19'' and 26'' fitted to the lifting beam 9'', are afterwards entrained over other guiding pulleys 36'' and wound round an adequate section of the rope drum 37''. The linking of the assembly 35'' of guiding pulleys and the beam 9'' provided with claws is maintained in the same manner as in the second embodiment. As is evident from the above, parts in FIGS. 7, 8 and 9 which are similar to those in FIGS. 1–5 inclusive, are designated by the same reference characters with added double primes.

A fourth embodiment is shown in FIG. 10, wherein the parts similar to those above described are designated by the same reference characters with added triple primes. If the loading and unloading operations involve the generation of horizontal forces having a tendency to destroy the balance of the system, for suppression of load swinging, as shown in FIG. 10, the beam 9''' is provided with claws hung both from the auxiliary beam 13''' and from the assembly 35''' of balance pulleys, of the tilting device 8''' by means of equal length members of chains 44'''.

The overhead crane with the C-shaped claws fitted to the lifting beam, in accordance with the invention, presents the following advantages:

It ensures about 30 per cent reduction of the weight of the overhead crane proper as composed to heretofore used overhead cranes having the same load capacity and span;

Due to the reduction of the weight of the overhead crane and especially due to the reduction of the weight of the load crab, lighter structures are possible for the crane runways and for their sustaining columns;

It ensures an optimum utilization of the building height, minimizing it by about 3.5m;

By simplifying the overhead crane design and by minimizing the weight of the overhead crane, the cost of the crane is lowered by about 40 per cent;

It increases the degree of utilization of the overhead crane for handling heavier loads and makes possible better access between various storing facilities for rolled products, when dismantling the attaching members of the lifting system together with the tilting C-shaped claws beam.

Although the invention is illustrated and described with reference to a plurality of preferred embodiments thereof, it is to be expressly understood that it is in no way limited to the disclosure of such a plurality of preferred embodiments, but is capable of numerous modifications within the scope of the appended claims.

What is claimed is:

1. In an overhead crane with a lifting beam provided with C-shaped claws, said crane having a load trolley on top of which there is a small load crab provided with a load hoisting unit and being rotatable about a vertical axis, the load hoisting unit having a tilting unit, the improvement which comprises:

means for lifting and loading the lifting beam, such means comprising a plurality of pairs of wire ropes having runs inclined with respect to each other, the starting ends of such ropes being secured to the load crab, and a balance system comprising first pulleys mounted on the lifting beam and additional second guiding pulleys being mounted on said load crab, and winding drums mounted on said load crab, the wire ropes being driven by said winding drums, the ropes after being entrained over said first pulleys of the balance system and being guided about said second guiding pulleys being wound upon the driven drums, and means selectively to correlate the tilting and rising movements of the lifting beam, said last-named means comprising a further pair of wire ropes having runs inclined with respect to each other, such further pair of wire ropes having their starting ends attached to the winding drums and guided by being entrained over pairs of third guiding pulleys mounted on said load crab, the opposite ends of the further wire ropes being entrained over fourth pulleys, the center of rotation of said fourth pulleys being located on one side of and at a distance from the longitudinal center line of the lifting beam, the fourth pulleys being located as near as possible to the horizontal plane passing through the centers of rotation of the first pulleys of the balance system on the lifting beam, a tilting mechanism having a driven rope winding drum, the further ropes after leaving the fourth pulleys being wound round the driven ropes winding drum of the tilting mechanism said fourth pulleys being used for both lifting and tilting and being pivotally connected by an attachment member to the C-shaped claws, the point of attachment of said attachment member of the C-shaped claws being located spaced from the longitudinal center line of the lifting beam on one side thereof.

2. An overhead crane in accordance with claim 1, wherein swinging movements of the lifting beam are suppressed by the inclined relation of the wire ropes.

3. An overhead crane in accordance with claim 1, wherein the first mentioned winding drums are located symmetrically with respect to the center line of the rotatable load crab.

4. An overhead crane in accordance with claim 1, comprising an auxiliary load beam, and where said first pulleys are attached to said auxiliary beam, further attachment members suspend said lifting beam from said auxiliary beam, the attaching members and the lifting beam being readily detachable from the said auxiliary beam, the load to be lifted then being hung on lifting hooks attached to the auxiliary load beam.

5. An overhead crane in accordance with claim 4, wherein a magnet is suspended from the auxiliary beam by means of chain members of equal length which suppress the horizontal forces which might throw the system out of balance in the process of loading and unloading loads.

* * * * *